US011674104B2

(12) United States Patent
Rajule et al.

(10) Patent No.: US 11,674,104 B2
(45) Date of Patent: Jun. 13, 2023

(54) LUBRICANT COMPOSITION CONTAINING ASHLESS TBN MOLECULES

(71) Applicant: VGP IPCO LLC, Lexington, KY (US)

(72) Inventors: Rajkumar Rajule, Kalyan West (IN); Jesse Dambacher, Lexington, KY (US)

(73) Assignee: VGP IPCO LLC, Lexington, KY (US)

( * ) Notice: Subject to any disclaimer, the term of this patent is extended or adjusted under 35 U.S.C. 154(b) by 0 days.

(21) Appl. No.: 17/574,252

(22) Filed: Jan. 12, 2022

(65) Prior Publication Data

US 2022/0135896 A1 May 5, 2022

Related U.S. Application Data

(62) Division of application No. 16/992,276, filed on Aug. 13, 2020, now Pat. No. 11,345,873.

(60) Provisional application No. 62/886,552, filed on Aug. 14, 2019.

(51) Int. Cl.

| | |
|---|---|
| ***C10M 133/44*** | (2006.01) |
| ***C10M 133/40*** | (2006.01) |
| ***C10M 169/04*** | (2006.01) |
| ***C10M 101/00*** | (2006.01) |
| ***C10M 107/00*** | (2006.01) |
| *C10N 40/25* | (2006.01) |
| *C10N 30/00* | (2006.01) |
| *C10N 20/02* | (2006.01) |

(52) U.S. Cl.

CPC ..... *C10M 133/40* (2013.01); *C10M 101/00* (2013.01); *C10M 107/00* (2013.01); *C10M 169/04* (2013.01); *C10M 2215/221* (2013.01); *C10N 2020/02* (2013.01); *C10N 2030/45* (2020.05); *C10N 2030/50* (2020.05); *C10N 2030/52* (2020.05); *C10N 2040/252* (2020.05); *C10N 2040/255* (2020.05)

(58) Field of Classification Search

CPC ..... C10M 133/40; C10M 101/00; C10M 107/00; C10M 169/04; C10M 2215/221; C10M 2215/22; C10M 133/38; C10N 2030/50; C10N 2030/52; C10N 2030/12; C10N 2040/255; C10N 2030/45; C10N 2040/252; C10N 2020/02

USPC ..... 508/192, 261

See application file for complete search history.

(56) References Cited

U.S. PATENT DOCUMENTS

| | | | |
|---|---|---|---|
| 2,524,392 | A | 2/1950 | Leffler et al. |
| 2,647,824 | A | 8/1953 | Jones et al. |
| 2,664,436 | A | 12/1953 | Heinrich |
| 2,766,205 | A | 10/1956 | Marshall et al. |
| 4,692,258 | A | 9/1987 | Rasberger et al. |
| 4,828,741 | A | 5/1989 | Meier et al. |
| 4,919,832 | A | 4/1990 | Meier et al. |
| 4,929,732 | A | 5/1990 | Meier et al. |
| 4,965,006 | A | 10/1990 | Meier et al. |
| 5,250,194 | A | 10/1993 | Hollis et al. |
| 2017/0175024 | A1 | 6/2017 | Trobaugh et al. |

FOREIGN PATENT DOCUMENTS

| | | | | |
|---|---|---|---|---|
| CN | 104447776 | A | 3/2015 | |
| EP | 2206764 | A1 | 7/2010 | |
| EP | 2366761 | A1 | 9/2011 | |
| WO | WO-2011100232 | A1 * | 8/2011 | ..... C07D 211/14 |
| WO | 2015023559 | A1 | 2/2015 | |
| WO | 2017025630 | A1 | 2/2017 | |

OTHER PUBLICATIONS

International Search Report and Written Opinion issued in PCT application No. PCT/US2020/046058, dated Nov. 24, 2020.

Krauss, Jurgen et al., "Synthesis and Biological Evaluation of Novel N-Alkyl Tetraand Decahydroisoquinolines: Novel Antifungals that Target Ergosterol Biosynthesis", Archiv der Pharmazie, 2014, vol. 347, Issue 4, pp. 283-290.

Non-Final Office Action issued in U.S. Appl. No. 16/992,276, dated Nov. 26, 2021.

Extended European Search Report dated Jan. 27, 2023 for European Application No. 20851919.9, 9 pages.

* cited by examiner

*Primary Examiner* — Prem C Singh
*Assistant Examiner* — Francis C Campanell
(74) *Attorney, Agent, or Firm* — Benesch, Friedlander, Coplan & Aronoff LLP

(57) ABSTRACT

New ashless TBN molecules are synthesized, and lubricant compositions containing them, boost the total base number. The lubricant compositions further tested for ASTM D6594 copper corrosion test meets ASTM limits.

4 Claims, No Drawings

LUBRICANT COMPOSITION CONTAINING ASHLESS TBN MOLECULES

RELATED APPLICATIONS

This application is a divisional application of U.S. patent application Ser. No. 16/992,276, filed Aug. 13, 2020, which claims benefit of U.S. Provisional Application No. 62/886,552 filed Aug. 14, 2019, the entire contents of which are incorporated by reference herein in their entirety.

FIELD OF INVENTION

Heteroaromatic or aromatic based ashless total base number (TBN) molecules are synthesized. Lubricant compositions comprising the ashless TBN molecules are provided.

Diesel fueled and gasoline fueled internal U combustion engines, emit carbon monoxide, hydrocarbons, nitrous oxides and particulates. To meet upcoming emission standards, original equipment manufacturers depend upon after treatment devices which include catalytic convertors, oxidation catalyst, reduction catalysts and particulate traps. These after treatment devices have limitations. Oxidation catalyst can become poisoned and become less effective by phosphorous and phosphorous containing compounds introduced by the exhaust gas and the degradation of phosphorous containing compounds. Reduction catalyst are sensitive to sulfur and sulfur containing compounds found in exhaust gas, which are formed by degradation of sulfur containing lubricant formulation. Similarly, particulate traps, too, become blocked by metallic ash produced from detergents used in lubricant formulation.

Over time, the combustion process in the engine generates acids and those acids will get into the lubricant formulations, to counteract the acidic products, detergents are used. Most current lubricant detergents contain calcium, magnesium or sodium, which produce ash as they are burnt. So development of Ashless total base number (TBN) is important to avoid ash formation altogether. Amines additives are an alternative to ash containing metal detergents and in particular, alkyl and aromatic amines. However, the addition of basic amine can lead to detrimental effect on seals and as well as on soft metals like copper and lead. Seal degradation leads to seal failure and leaks, which harm engine performance and damage engine. A narrow window exists where ashless molecules can titrate both with ASTM D2896 and ASTM D4793 without causing harm to seals and corrosion to soft metals.

U.S. Pat. Nos. 5,525,247; 5,672,570; and 6,569,818 are directed to "low ash" lubricating oil compositions in which sulfated ash content is reduced by replacing overbased detergents with neutral detergents. US patent 2007/0203031 describes the use of high TBN nitrogen containing dispersants as ashless TBN sources.

SUMMARY

Provided herein are stabilized lubricant compositions, preferably crankcase lubricating compositions for heavy duty diesel engine. The lubricant oil including a base oil and one or more ashless TBN molecules.

Other methods, features and/or advantages is, or will become, apparent upon examination of the following figures and detailed description. It is intended that all such additional methods, features, and advantages be included within this description and be protected by the accompanying claims.

DETAILED DESCRIPTION

As used herein, the term "organic group" is used to mean a hydrocarbon group that is classified as an aliphatic group, cyclic group, or combination of aliphatic and cyclic groups (e.g., alkaryl and aralkyl groups). In the context of the present invention, suitable organic groups for the compounds of this invention are those that do not interfere with the anti-aging activity of the compounds. In the context of the present invention, the term "aliphatic group" means a saturated or unsaturated linear or branched hydrocarbon group. This term is used to encompass alkyl, alkenyl, and alkynyl groups, for example.

As used herein the term hydrocarbyl is inclusive of a number of carbon atoms in any configuration. For example a $C_6$ hydrocarbyl group comprises alkyl, aryl and cycloalkyl configurations. The carbon atoms of the hydrocarbyl group may be saturated or unsaturated.

As used herein, the terms "alkyl", "alkenyl", and the prefix "alk-" are inclusive of straight chain groups and branched chain groups. Unless otherwise specified, these groups contain from 1 to 20 carbon atoms, with alkenyl groups containing from 2 to 20 carbon atoms. In some embodiments, these groups have a total of at most 10 carbon atoms, at most 8 carbon atoms, at most 6 carbon atoms, or at most 4 carbon atoms. Alkyl groups including 4 or fewer carbon atoms can also be referred to as lower alkyl groups. Alkyl groups can also be referred to by the number of carbon atoms that they include (i.e., $C_1$-$C_4$ alkyl groups are alky groups including 1-4 carbon atoms).

Cycloalkyl, as used herein, refers to an alkyl group (i.e., an alkyl, alkenyl, or alkynyl group) that forms a ring structure. Cyclic groups can be monocyclic or polycyclic and preferably have from 3 to 10 ring carbon atoms. A cycloalkyl group can be attached to the main structure via an alkyl group including 4 or less carbon atoms. Exemplary cyclic groups include cyclopropyl, cyclopropylmethyl, cyclopentyl, cyclohexyl, adamantyl, and substituted and unsubstituted bornyl, norbornyl, and norbornenyl.

Unless otherwise specified, "alkylene" and "alkenylene" are the divalent forms of the "alkyl" and "alkenyl" groups defined above. The terms, "alkylenyl" and "alkenylenyl" are used when "alkylene" and "alkenylene", respectively, are substituted. For example, an arylalkylenyl group comprises an alkylene moiety to which an aryl group is attached.

The term "aryl" as used herein includes carbocyclic aromatic rings or ring systems. Examples of aryl groups include phenyl, naphthyl, biphenyl, fluorenyl and indenyl. Aryl groups may be substituted or unsubstituted.

Unless otherwise indicated, the term "heteroatom" refers to the atoms O, S, or N. The term "heteroaryl" includes aromatic rings or ring systems that contain at least one ring heteroatom (e.g., O, S, N). In some embodiments, the term "heteroaryl" includes a ring or ring system that contains 2 to 12 carbon atoms, 1 to 3 rings, 1 to 4 heteroatoms, and O, S, and/or N as the heteroatoms. Suitable heteroaryl groups include furyl, thienyl, pyridyl, quinolinyl, isoquinolinyl, indolyl, isoindolyl, triazolyl, pyrrolyl, tetrazolyl, imidazolyl, pyrazolyl, oxazolyl, thiazolyl, benzofuranyl, benzothiophenyl, carbazolyl, benzoxazolyl, pyrimidinyl, benzimidazolyl, quinoxalinyl, benzothiazolyl, naphthyridinyl, isoxazolyl, isothiazolyl, purinyl, quinazolinyl, pyrazinyl, 1-oxidopyridyl, pyridazinyl, triazinyl, tetrazinyl, oxadiazolyl, thiadiazolyl, and so on.

The terms "arylene" and "heteroarylene" are the divalent forms of the "aryl" and "heteroaryl" groups defined above. The terms "arylenyl" and "heteroarylenyl" are used when "arylene" and "heteroarylene", respectively, are substituted. For example, an alkylarylenyl group comprises an arylene moiety to which an alkyl group is attached.

When a group is present more than once in any formula or scheme described herein, each group (or substituent) is independently selected, whether explicitly stated or not. For example, for the formula —C(O)—$NR_2$ each R group is independently selected.

As a means of simplifying the discussion and the recitation of certain terminology used throughout this application, the terms "group" and "moiety" are used to differentiate between chemical species that allow for substitution or that may be substituted and those that do not so allow for substitution or may not be so substituted. Thus, when the term "group" is used to describe a chemical substituent, the described chemical material includes the unsubstituted group and that group with nonperoxidic O, N, S, Si, or F atoms, for example, in the chain as well as carbonyl groups or other conventional substituents. Where the term "moiety" is used to describe a chemical compound or substituent, only an unsubstituted chemical material is intended to be included. For example, the phrase "alkyl group" is intended to include not only pure open chain saturated hydrocarbon alkyl substituents, such as methyl, ethyl, propyl, tert-butyl, and the like, but also alkyl substituents bearing further substituents known in the art, such as hydroxy, alkoxy, alkylsulfonyl, halogen atoms, cyano, nitro, amino, carboxyl, etc. Thus, "alkyl group" includes ether groups, haloalkyls, nitroalkyls, carboxyalkyls, hydroxyalkyls, cyanoalkyls, etc. On the other hand, the phrase "alkyl moiety" is limited to the inclusion of only pure open chain saturated hydrocarbon alkyl substituents, such as methyl, ethyl, propyl, tert-butyl, and the like.

Described herein are lubricant composition comprising: a base oil of lubricating viscosity and an ashless TBN lubricant oil of a structure of either formula A, 1A, B, 1B, 2B, C, 1C, 2C, 3C, D, 1D or any combination thereof.

In some aspects the ashless TBN additive of the lubricant oil comprises Formula A:

(Formula A)

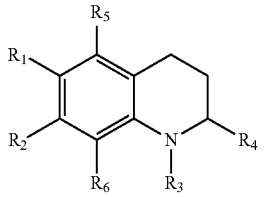

where $R_1$, $R_2$, $R_5$, $R_6$ are each independently hydrogen; a $C_1$ to $C_6$ hydrocarbyl group; a $C_1$ to $C_6$ alkyl, aryl or alkoxy group, or a $C_1$ to $C_6$ hydrocarbyl group further comprising an ether linkage to a —$O(CH_2)_n$—$CH_3$ group where n=0-3; $R_3$ is an unsubstituted straight chain $C_5$ to $C_{12}$ alkyl group, optionally containing an ether linkage; and $R_4$ is hydrogen or a $C_1$ to $C_5$ alkyl group. In some aspects the lubricant composition comprising formula A, $R_1$ and $R_2$ are each independently a $C_1$ to $C_5$ alkyl group. In some aspects when the lubricant composition comprises formula A, $R_1$, $R_2$, $R_5$, and $R_6$ are each hydrogen.

In some aspects the lubricant composition comprises any ashless TBN in weight % based on the weight of the final lubricant oil formulation between about 0.1 weight % to about 10 weight % and base oil in a weight % based on the weight of the final formulation of between about 50% and about 99%.

In some aspects the ashless TBN additive of the lubricant oil comprises Formula B:

(Formula B)

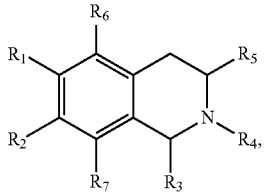

wherein $R_1$, $R_2$, $R_6$, $R_7$ are each independently a $C_1$ to $C_6$ hydrocarbyl group; a $C_1$ to $C_6$ alkyl, aryl or alkoxy group, or a $C_1$ to $C_6$ hydrocarbyl group further comprising an ether linkage to a —$O(CH_2)_n$—$CH_3$ group where n=0-3; $R_3$ and $R_5$ are each independently an unsubstituted straight chain $C_1$ to $C_5$ alkyl group, optionally containing an ether linkage, and $R_4$ is optionally an unsubstituted straight chain $C_5$ to $C_{12}$ alkyl group, optionally containing an ether linkage. In some aspects, the lubricant composition comprising Formula B comprises an ashless TBN where $R_1$ and $R_2$ are each independently are each independently a $C_1$ to $C_5$ alkyl group.

In some aspects the ashless TBN additive of the lubricant oil comprises Formula C:

(Formula C)

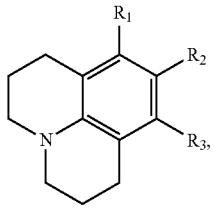

wherein $R_1$, $R_2$, $R_3$ are each independently hydrogen; a $C_1$ to $C_6$ hydrocarbyl group; a $C_1$ to $C_6$ alkyl, aryl or alkoxy group, or a $C_1$ to $C_6$ hydrocarbyl group further comprising an ether linkage to a —$O(CH_2)_n$—$CH_3$ group where n=0-3. In some aspects the ashless TBN additive of formula B, wherein $R_1$, $R_2$ are each independently a $C_5$ to $C_{12}$ alkyl group optionally containing an ether linkage.

In some aspects the ashless TBN additive of the lubricant oil comprises Formula D:

Formula D

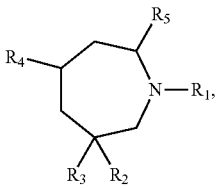

wherein $R_1$ is optionally a $C_5$ to $C_{12}$ alkyl group optionally containing an ether linkage, and $R_2$, $R_3$, $R_4$ and $R_5$ are each independently straight or branched chain $C_1$ to $C_5$ alkyl groups.

Base Lubricant Oil

A base oil of lubricating viscosity is the integral part of lubricant composition providing performance and characteristics benefits. A base oil in the present context is a natural oil derived from animal or vegetable derived, mineral oil, synthetic or combination of all. Generally, the viscosity of the oil ranges from about 2 $mm^2s^{-1}$ to about 40 $mm^2s^{-1}$, especially from about 4 $mm^2s^{-1}$ to about 20 $mm^2s^{-1}$ as measured at 100° C.

Natural oils include for example castor oil, lard oil etc., mineral lubricating oils such as liquid petroleum oils and solvent treated or acid treated mineral lubricating oils of the paraffinic, naphthenic or mixed parafinic-naphthenic types and oils derived from coal or shale or mixtures thereof.

Synthetic lubricating oils includes hydrocarbon oils such as polymerized and interpolymerized olefins e.g., polybutylenes, polypropylenes, propyleneisobutylene copolymers, polyhexenes, polyoctenes, polydecene and mixtures thereof; mono and dialkyl benzenes e.g. dodecylbenzenes, tetradecyl benzenes, dinonylbenzenes, di-(2-ethylhexyl)benzenes; polyphenyls e.g. biphenyls, terphenyls, alkylated polyphenyls; diphenyl alkanes and alkyl diphenyl alkanes; alkylated diphenyl ethers and alkylated diphenyl sulfides and the derivatives, analogs and homologs thereof or mixtures thereof. Other useful synthetic oils derived from gas to liquid process from Fischer-Tropsch synthesized hydrocarbons, which are commonly referred as GTL base oils (Gas to Liquid).

Another suitable class of synthetic lubricating oils comprises of esters of dicarboxylic acids (e.g., phthalic acid, succinic acid, alkyl succinic acid and alkenyl succinic acids, maleic acid, azelaic acid, suberic acid, sebasic acid, fumaric acid, adipic acid, linoleic acid dimer, malonic acid, alkyl malonic acids, alkenyl malonic acids with variety of alcohols such as butyl alcohol, hexyl alcohol, dodecyl alcohols, 2-ethylhexylalcohol, ethylene glycol, diethylene glycol monoether, propylene glycol.

Oil of lubricating viscosity may also be defined as specified in the American petroleum institute (API) base oil interchangeability guidelines. The five base oil groups are as follows; Group I (sulfur content >0.03 wt %, and/or <90 wt % saturates, viscosity index 80-120); Group II (sulfur content <0.03 wt % and >90 wt % saturates, viscosity index 80-120); Group III (sulfur content <0.03 wt %, and >90 wt % saturates, viscosity index >120); group IV all polyalphaolefins (PAOs); group V, all others not included in group I, II, III or IV). The oil of lubricating compositions comprises of API group I to V and mixtures thereof.

The lubricating oil in the invention will normally comprise the major amount of the composition. Thus it will be at least 50% by weight of the composition, such as 51 to 99% or 83 to 98% or 88% to 90%.

Additives

The lubricants may include dispersants, detergents, antioxidants, anti-wear agents, viscosity modifiers, pour point depressants, other friction modifiers, corrosion inhibitors, anti-foaming agents demulsifiers, or seal swell agents are used in amounts generally encountered in the art, for example between about 0.01 wt % and about 20 wt %, or between 1 wt % and about 20 wt %. The lubricant may also contain a wt % of additive of any single number found within the range between about 0.01 wt % and about 20 wt %, for example, 0.5 wt %, or 6.4 wt %.

Viscosity modifiers are also called as viscosity index improver or viscosity improvers. This may be included in the formulation. Viscosity index improver include reaction product of amines for example polyamines, with a hydrocarbyl substituent mono or dicarboxylic acid in which hydrocarbyl substituent comprises a chain of sufficient length to impart viscosity index improving properties to the compounds. In general, the viscosity improver may be polymer of a $C_4$ to $C_{24}$ unsaturated ester of unsaturated alcohol or $C_3$ to $C_{10}$ unsaturated monocarboxylic acid or a $C_4$ to $C_{10}$ dicarboxylic acid with an unsaturated nitrogen containing monomer having 4 to 20 carbon atoms, a polymer of $C_2$ to $C_{20}$ olefin with an unsaturated $C_3$ to $C_{10}$ mono or dicarboxylic acid neutralized with an amine, hydroxyl amine or an alcohol; or a polymer of ethylene with a $C_3$ to $C_{20}$ olefin further reacted either by grafting a $C_4$ to $C_{20}$ unsaturated nitrogen containing monomer or by grafting with an unsaturated acid on to the polymer backbone and then reacting carboxylic group of the grafted acid with amine, hydroxylamine or alcohol. Formulation may also include multifunctional viscosity modifier which may have both dispersant and antioxidant properties.

A viscosity modifier may be present in the final formulation in an amount from about 0.1 wt % to about 10 wt % on a pure rubber basis. In some aspects a viscosity modifier is selected so as to provide the final formulation rubber in an amount between about 0.1 wt % and 2 wt %. The amount of rubber in the final formulation may be between about 0.1 wt % and about 1 wt % or any number within that range, e.g. 0.7 wt %.

Pour point depressant are used to allow the lubricant formulation to operate at lower temperature. Typical additives which improves the fluidity of lubricant formulation are $C_5$ to Cis dialkyl fumarate/vinyl acetate copolymer and polymethacrylates.

The additives may be added individually or as an additive package.

Ashless TBN

The ashless TBN molecules ashless that is of a structure of either formula A, 1A, B, 1B, 2B, C, 1C, 2C, 3C, D, 1D or any combination thereof are compatible with any type of base oil. The ashless TBN molecules can be added to fully synthetic or partially synthetic or any commercially available lubricant or lubricant oil. The ashless TBN molecules typically comprise a fraction of the final formulation that is about 0.01 wt % to about 10 wt %. The ashless TBN molecules may be present in an amount between about 1 wt % and about 10 wt %. The ashless TBN molecules may be present in any numerical amount about 0.1 wt % and about 10 wt %, for example 1.2 wt %.

TBN Performance

The total base number (TBN) of a lubricating oil composition can be determined by two method ASTM D2896 and ASTM D4739. ASTM D2896 (Potentiometric perchloric acid titration) and ASTM D4739 (potentiometric hydrochloric acid titration). ASTM D 2896 uses a stronger acid than ASTM D4739 and a more polar solvent system, it is often used in fresh oil specifications. ASTM D4739 method is favored in engine tests and with used oil to measure TBN depletion/retention, in general it has lower TBN value.

Copper Corrosion Test

ASTM D6594 method is intended to simulate the corrosion of non-ferrous metals such as copper, lead, tin, phosphorous and bronze. In the present context we used copper and lead. Copper and lead specimen are immersed in measured amount of lubricant formulation containing A, 1A, B, 1B, 2B, C, 1C, 2C, 3C, D, or 1D and also reference oil (In the present context 100 ml, containing 1 wt % ashless TBN). The lubricant composition is heated to temperature of 135°

C., for period of 168 h. After 168 h, lubricant formulation is brought to ambient temperature, the specimens were rated for tarnish according to method D130. Test method D5185 was used to determine the concentration of copper and lead in all the formulas and compared with reference oil using ICP-AES.

EXAMPLES

Structures of Ashless TBN components

The structures of ashless TBN components synthesized are shown in Table 1:

| Compounds | Structure |
|---|---|
| 1-decyl-1,2,3,4-tetrahydroquinoline (Formula 1A) | 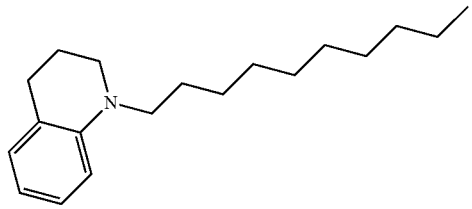 Molecular Weight: 273.46 |
| 2-decyl-1,2,3,4-tetrahydroquinoline (Formula 1B) | 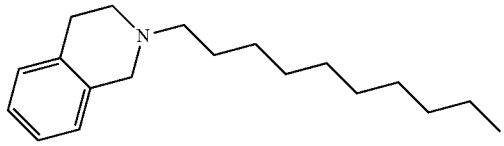 Molecular Weight: 273.46 |
| 6,7-dimethoxy-2-octadecyl-1,2,3,4-tetrahydroquinoline (Formula 2B) | 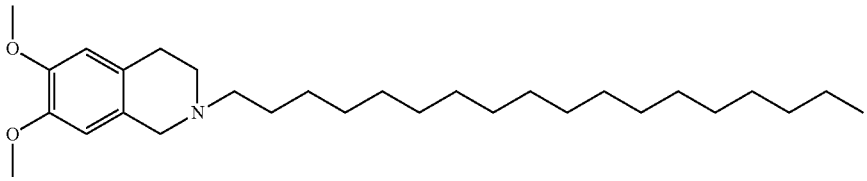 Molecular Weight: 445.73 |
| 8-methoxy-2,3,6,7-tetrahydro-1H,5H-pyrido[3,2,1-ij]quinolone (Formula 1C) | 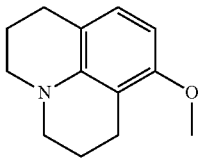 Molecular Weight: 203.29 |
| 9-heptyl-2,3,6,7-tetrahydro-1H,5H-pyrido[3,2,1-ij]quinolone (Formula 2C) | 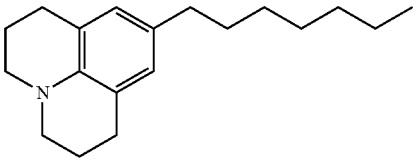 Molecular Weight: 271.45 |
| 2,3,6,7-tetrahydro-1H,5H-pyrido[3,2,1-ij]quinolone (Formula 3C) | 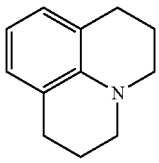 Molecular Weight: 173.26 |

-continued

| Compounds | Structure |
|---|---|
| 1-decyl azepane (Formula 1D) | 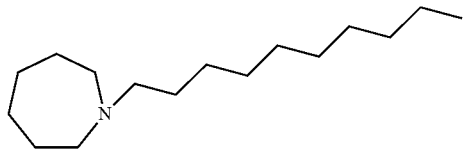 Molecular Weight: 239.45 |

Synthesis and Characterization of Ashless TBN Molecules

Synthesis of 1-decyl-1,2,3,4-tetrahydroquinoline (Formula 1A)

In one neck round bottom flask fitted with condenser and magnetic stirrer, placed (1.0 g, 7.5 mmoles) of 1,2,3,4-tetrahydroquinoline in dimethylsulfoxide (5 ml). To the above solution potassium hydroxide (0.42 g, 7.5 mmoles) was added. The reaction mixture was stirred at ambient temperature for 30 min and added 1-iododecane (1.91 g, 0.95 mmoles) and slowly heated to 50° C. The completion of reaction checked by thin layer chromatography. After the completion of reaction, reaction mixture was quenched with ice cubes and stirred for half an hour. The reaction mixture was extracted with ethyl acetate, layers were separated. Organic layer was dried with sodium sulfate and concentered under reduced pressure. The crude product purified by silica gel chromatography using hexane and ethyl acetate as eluents. Yield=68%.

$1^{H}$NMR (400 MHz, $CDCl_3$); δ 7.01 (m, 1H), 6.90 (m, 1H), 6.53 (m, 2H), 3.28-3.17 (m, 4H), 2.73 (q, 6 Hz, 2H), 1.92 (m, 2H), 1.57 (m, 2H), 1.30 (m, 14H), 0.90 (m, 3H).

$^{13}$CNMR, 145.44, 129.23, 127.18, 122.17, 115.32, 110.55, 51.66, 49.58, 32.10, 29.88, 29.78, 29.53, 28.39, 27.47, 26.35, 22.81, 22.44, 14.30, 14.23.

Synthesis of 2-decyl-1,23,4-tetrahydroquinoline (Formula 1B)

In one neck round bottom flask fitted with condenser and magnetic stirrer, placed (8.5 g, 63.9 mmoles) of 1,2,3,4-tetrahydroisoquinoline in acetonitrile (85 ml). To the above solution potassium carbonate (8.84 g, 64 mmoles) was added. The reaction mixture was slowly heated 70° C. and kept at that temperature for 30 min. After 30 min reaction mixture brought to ambient temperature and added 1-iododecane (16 g, 60 mmoles). The reaction mixture further was stirred overnight at ambient temperature; completion of the reaction was checked by thin layer chromatography. After the completion of reaction, acetonitrile was removed from the reaction mixture under reduced pressure. The crude product obtained was quenched with water and extracted with ethyl acetate. The product was isolated from ethyl acetate under reduced pressure. The product was purified by silica gel chromatography using hexane and ethyl acetate as eluents to get yellow colored oil Yield=73%.

$1^{H}$NMR (400 MHz, $CDCl_3$); δ 7.13-7.07 (m, 3H), δ 7.03-6.98 (m, 1H), 3.62 (s, 2H), 2.90 (t, J=5.6 Hz, 2H), 2.75-2.69 (m, 2H), 2.52-2.46 (m, 2H), 1.65-1.55 (m, 2H), 1.39-1.23 (m, 14H), 0.91-0.86 (m, 3H).

$^{13}$C NMR, 134.99, 134.40, 128.58, 126.55, 125.97, 125.48, 58.61, 56.27, 51.00, 31.88, 29.61, 29.57, 29.30, 29.14, 27.63, 27.26, 22.65, 14.07.

Synthesis of 6,7-dimethoxy-2-octadecyl-1,2,3,4-tetrahydroquinoline (Formula 2B)

1,2,3,4-Tetrahydro-6,7-dimethoxyisoquinoline was prepared using the procedure from *Journal of Medicinal Chemistry* 59(10), 5063, 2016.

In one neck flask fitted with condenser and magnetic stirrer placed 1,2,3,4-tetrahydro-6,7-dimethoxyisoquinoline (0.25 g, 1.29 mmoles) in ethanol (2.5 ml) and added potassium carbonate (0.21 g, 1.55 mmoles). The reaction mixture stirred for 15 to 20 min at ambient temperature and 1-iodooctadecane (0.36 g, 1.36 mmoles) was added. The reaction mixture was allowed to stir at ambient temperature for 18 h. The reaction mixture was concentrated to remove ethanol under reduced pressure, the crude obtained was quenched with water, extracted with ethyl acetate. Two layers were separated; organic layer was dried with sodium sulfate and concentrated under reduced pressure. The crude product was purified using silica gel chromatography with hexane and ethyl acetate as eluents. Yield (84%).

$1^{H}$NMR (400 MHz, $CDCl_3$); δ 6.57 (s, 1H), 6.51 (s, 1H), 3.82 (S, 3H), 3.81 (s, 3H), 3.54 (s, 2H), 2.81 (t, J=5.6 Hz, 6 Hz, 2H), 2.70 (t, J=6 Hz, 2H), 2.48 (t, J=8.4 Hz, 2H), δ 1.62-1.52 (m, 2H), 1.36-1.21 (m, 30H), 0.868 (t, J=6.8 Hz, 3H).

$^{13}$C NMR (CDCl3); 147.47, 147.16, 126.65, 126.20, 111.35, 109.49, 58.48, 55.89, 55.87, 55.78, 51.03, 31.89, 29.67, 29.61, 29.59, 29.33, 28.60, 27.62, 27.24, 22.66, 14.08.

Synthesis of 8-methoxy-2,3,6,7-tetrahydro-1H,5H-pyrido [3,2,1-ij] quinolone (Formula 1C) was prepared according to literature procedure *Journal of Organic Chemistry,* 52(8), 1465-8; 1987.

Synthesis of 9-heptyl-2,3,6,7-tetrahydro-1H,5H-pyrido [3,2,1-ij] quinolone (Formula 2C)

In a sealed tube 4-Heptylaniline (1.09 g, 5.69 mmoles), sodium carbonate (2.2 g, 21 mmoles) and 1-Bromo-3-chloropropane (15 ml) was taken and reaction mixture was heated to 145° C. for 3 days. After completion of reaction, it was cooled to ambient temperature and excess 1-bromo-3-chloropropane was distilled off under vacuum. The crude product was purified by silica gel chromatography using hexane and ethyl acetate as eluents. Yield (59%).

$1^{H}$NMR (400 MHz, $CDCl_3$); δ 6.60 (s, 2H), 3.06 (t, J=5.6 Hz, 4H), 2.72 (t, J=6.8 Hz, 4H), 2.39 (t, J=8 Hz, 2H), 1.96 (q, J=6.8 Hz, 5.6 Hz, 4H), 1.53 (q, J=7.2 Hz, 8 Hz, 2H), δ 1.37-1.24 (m, 8H), δ 0.878 (t, J=7.2 Hz, 3H).

$^{13}$C NMR, δ 141.04, 130.54, 126.88, 121.67, 50.21, 35.10, 31.98, 31.89, 29.55, 29.28, 27.61, 22.72, 22.39.

Synthesis of 2,3,6,7-tetrahydro-1H,5H-pyrido[3,2,1-ij] quinolone (Formula 3C) was prepared using *Journal of Heterocyclic Chemistry,* 19(4), 925-6; 1982.

Synthesis of 1-decyl azepane (Formula 1D)

In one neck round bottom flask fitted with condenser and magnetic stirrer placed 1-Azacycloheptane (0.2 g, 2.02 mmoles) in acetonitrile (8 ml). To the above solution potassium carbonate (0.33 g, 2.39 mmoles) was added and reaction mixture slowly heated to reflux. After completion of reaction, reaction mixture was cooled to ambient temperature. The reaction mixture was further concentrated under reduced pressure to remove acetonitrile. The product was washed with water, brine and extracted with ethyl acetate. Layers were separated, organic layer was dried with sodium sulfate and concentrated using rotavap. The crude product obtained was purified by silica gel chromatography using hexane and ethyl acetate as eluents (Yield=72%).

$1^{H}$NMR (400 MHz, $CDCl_3$); δ 2.47 (t, J=5.6 Hz, 4H), 2.29 (t, J=8 Hz, 7.6 Hz, 2H), 1.54-1.39 (m, 8H), 1.31 (m, 2H), 1.16-1.04 (m, 16H), 0.71 (t, 6.4 Hz, 6.8 Hz, 3H).

$^{13}$CNMR, CDCl3, 58.34, 55.45, 31.86, 31.79, 29.59, 29.54, 29.28, 29.17, 27.58, 27.50, 27.21, 26.98, 22.64, 22.61, 14.07.

Final Formulation

In some aspects the final formulation may comprise a base oil, a viscosity modifier and an ashless TBN molecule that is of a structure of either formula A, 1A, B, 1B, 2B, C, 1C, 2C, 3C, D, 1D, or any combination thereof. The final formulation may comprise a base oil, a viscosity modifier and an ashless TBN molecule that is of a structure of either formula A, 1A, B, 1B, 2B, C, 1C, 2C, 3C, D, 1D, or any combination thereof and additional additives. The final formulation may comprise a base oil in an amount from about 80 wt % to about 99.8 wt %; an ashless TBN molecule that is of a structure of either formula A, 1A, B, 1B, 2B, C, 1C, 2C, 3C, D, 1D or any combination thereof in an amount from about 0.1 wt % to about 10 wt %, a viscosity modifier on a pure rubber basis in an amount from about 0.1 wt % to about 10 wt %. The final formulation may comprise a base oil in an amount from about 60 wt % to about 98.8 wt %; an ashless TBN molecule that is of a structure of either formula A, 1A, B, 1B, 2B, C, 1C, 2C, 3C, D, 1D or any combination thereof in an amount from about 0.1 wt % to about 10 wt %, a viscosity modifier in an amount from about 0.1 wt % to about 10 wt % on a pure rubber basis, and additives in an amount between about 1 wt % and about 20 wt %.

The final formulation may comprise a base oil, rubber and an ashless TBN molecule that is of a structure of either formula A, 1A, B, 1B, 2B, C, 1C, 2C, 3C, D, 1D, or any combination thereof and optionally additives. The final formulation may comprise base oil in an amount from about 60 wt % to about 98.8 wt %; an ashless TBN molecule that is of a structure of either formula A, 1A, B, 1B, 2B, C, 1C, 2C, 3C, D, 1D or any combination thereof in an amount from about 0.1 wt % to about 10 wt %, rubber in an amount from about 0.1 wt % to about 10 wt %, and additives in an amount between about 1 wt % and about 25 wt %.

In some aspects the ashless TBN, additive package, or viscosity modifier may be in the form of a concentrate that is diluted to supply the final formulation.

Weight Percent Definition

All weight (and mass) percents expressed herein (unless otherwise indicated) are based on active ingredient content of the additive, and/or additive package, exclusive of any associated diluent. The invention will be further understood by reference to the following examples, wherein all parts by weight (or mass), unless otherwise noted.

Formulation Preparation

A lubricant reference (Table 2) was formulated as follows:

TABLE 2

Reference lubricant formulation

| Components | Weight % |
|---|---|
| Base oil | 81.3% |
| Viscosity modifier | 0.7% |
| Additive package | 18% |

A lubricant sample formulation was made according to Table 3 for each of the molecules of Table 1.

TABLE 3

Sample lubricant formulation

| Components | Weight % |
|---|---|
| Base oil | 80.3% |
| Viscosity modifier | 0.7% |
| Additive package | 18 |
| Ashless TBN component(Table 1) | 1% |

Results

Results of ASTMD 2896 and ASTM D4739 are found in Table 4.

| Sample ID | TBN mg KOH/g (ASTM D2896) | Δ TBN against reference | TBN mg KOH/g (ASTM D4739) | Δ TBN against reference |
|---|---|---|---|---|
| Reference | 8.99 | — | 7.82 | — |
| (Formula 1A) | 10.61 | 1.62 | 7.54 | −0.28 |
| (Formula 1B) | 11.11 | 2.12 | 9.52 | 1.70 |
| (Formula 2B) | 9.98 | 0.99 | 8.81 | 0.99 |
| (Formula 1C) | 11.7 | 2.71 | 7.47 | −0.35 |
| (Formula 2C) | 11.22 | 2.23 | 8.37 | 0.55 |
| (Formula 3C) | 11.81 | 2.82 | 7.40 | −0.42 |
| (Formula 1D) | 11.01 | 2.02 | 9.05 | 1.23 |

Results of ASTMD D6594 (Copper strip rating) are found in Table 5:

| Sample No. | Copper strip rating | Cu content (ppm) | | Lead content (ppm) | |
|---|---|---|---|---|---|
| | | Before | After | Before | After |
| Reference | 4b | 1 | 539 | 1 | 1 |
| (Formula 1A) | 1a | <1 | 12 | <1 | 3 |
| (Formula 1B) | 1a | <1 | 8 | <1 | 6 |
| (Formula 2B) | 1b | 1 | 128 | <1 | 18 |
| (Formula 1C) | 1b | <1 | 206 | <1 | 6 |
| (Formula 2C) | 4a | 1 | 437 | 1 | 107 |
| (Formula 3C) | 1b | 1 | 66 | <1 | 5 |
| (Formula 1D) | 1b | 2 | 97 | <1 | 17 |

The Samples comprising the ashless TBN represented by formula 1A and 1B provide good TBN and meet ASTM corrosion limits.

Certain embodiments have been described in the form of examples. It is impossible to depict every potential application. Thus, while the embodiments are described in considerable detail, it is not the intention to restrict or in any way limit the scope of the appended claims to such detail, or to any particular embodiment.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When "only A or B but not both" is intended, then the term "only A or B but not both" will be employed. Thus, use of the term "or" herein is the inclusive, and not the exclusive use. As used in the specification and the claims, the singular forms "a," "an," and "the" include the plural. Finally, where the term "about" is used in conjunction with a number, it is intended to include ±10% of the number. For example, "about 10" may mean from 9 to 11.

As stated above, while the present application has been illustrated by the description of embodiments, and while the embodiments have been described in considerable detail, it is not the intention to restrict or in any way limit the scope of the appended claims to such detail. Additional advantages and modifications will readily appear to those skilled in the art, having the benefit of this application. Therefore, the application, in its broader aspects, is not limited to the specific details and illustrative examples shown. Departures may be made from such details and examples without departing from the spirit or scope of the general inventive concept.

The invention claimed is:

1. A lubricant composition comprising:
a base oil of lubricating viscosity, and
an ashless TBN lubricant oil additive Formula D

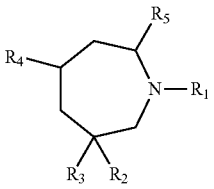

wherein $R_1$ is a $C_5$ to $C_{12}$ alkyl moiety, and $R_2$, $R_3$, $R_4$ and $R_5$ are each independently hydrogen or a straight or branched chain $C_1$ to $C_5$ alkyl groups.

2. The lubricant composition of claim 1, wherein the ashless TBN lubricant oil additive is (Formula 1D)

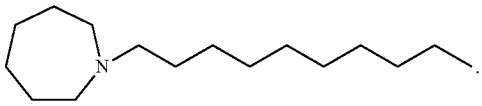

Molecular Weight: 239.45

3. The lubricant composition of claim 1, comprising the ashless TBN additive in weight % based on the weight of the final lubricant oil formulation between about 0.1 weight % to about 10 weight %.

4. The lubricant composition of claim 1, comprising base oil in a weight % based on the weight of the final formulation of between about 63% and about 98.9%, an ashless TBN additive in weight % based on the weight of the final lubricant oil formulation between about 0.1 wt % to about 10 wt %, a viscosity modifier in a weight % based on the weight of the final formulation of between about 0.1 wt % and about 2 wt %, and an additive package in a weight % based on the weight of the final formulation of between about 1 wt % and about 25 wt %.

* * * * *